US009269512B2

(12) United States Patent
Colonna et al.

(10) Patent No.: US 9,269,512 B2
(45) Date of Patent: Feb. 23, 2016

(54) ROCKER SWITCH AND METHOD OF OPERATING SAME

(71) Applicant: Delta Systems, Inc., Streetsboro, OH (US)

(72) Inventors: Pat Joseph Colonna, Canfield, OH (US); Ernest Richard Buehman, Maple Heights, OH (US)

(73) Assignee: Delta Systems, Inc., Streetsboro, OH (US)

( * ) Notice: Subject to any disclaimer, the term of this patent is extended or adjusted under 35 U.S.C. 154(b) by 307 days.

(21) Appl. No.: 13/927,629

(22) Filed: Jun. 26, 2013

(65) Prior Publication Data

US 2015/0001056 A1 Jan. 1, 2015

(51) Int. Cl.

| | |
|---|---|
| ***H01H 21/08*** | (2006.01) |
| ***H01H 23/02*** | (2006.01) |
| ***H01H 3/14*** | (2006.01) |
| ***H01H 13/06*** | (2006.01) |
| ***H01H 13/18*** | (2006.01) |

(52) U.S. Cl.

CPC ..... *H01H 23/02* (2013.01); *H01H 3/14* (2013.01); *H01H 13/06* (2013.01); *H01H 13/186* (2013.01); *H01H 21/08* (2013.01)

(58) Field of Classification Search

CPC ..... H01H 3/04; H01H 3/046; H01H 23/02

USPC ..... 200/335, 339, 16 B, 17 R, 529–531

See application file for complete search history.

(56) References Cited

U.S. PATENT DOCUMENTS

| | | | | |
|---|---|---|---|---|
| 4,316,065 | A * | 2/1982 | Rupp et al. | 200/16 B |
| 4,673,778 | A * | 6/1987 | Lewandowski et al. | 200/467 |
| 5,221,816 | A | 6/1993 | Williams | |
| 5,528,007 | A * | 6/1996 | Williams et al. | 200/16 B |
| 5,929,407 | A * | 7/1999 | Ziem | 200/16 B |
| 6,330,838 | B1 * | 12/2001 | Kalsi | 200/61.89 |
| 6,399,908 | B1 * | 6/2002 | Mueller et al. | 200/249 |

* cited by examiner

*Primary Examiner* — Amy Cohen Johnson
*Assistant Examiner* — Marina Fishman
(74) *Attorney, Agent, or Firm* — Tarolli, Sundheim, Covell & Tummino, LLP

(57) ABSTRACT

A rocker switch assembly and method includes a housing having an interior cavity for locating electronic components and a plunger member movably located during actuation within the interior cavity of the housing. The plunger member is coupled to at least one contact support. The switch assembly further comprises at least one terminal fixed within the housing. The at least one terminal corresponding with the at least one contact that engages or disengages with the terminal during actuation. A lever structure is pivotly coupled to the housing by a fulcrum fixedly attached to the housing. The lever structure comprises a lever having an upper side for receiving an external force and a lower side for engaging a head on the plunger member to generate actuation of the rocker switch during pivotal rotation of the lever.

16 Claims, 10 Drawing Sheets

ROCKER SWITCH AND METHOD OF OPERATING SAME

TECHNICAL FIELD

The present disclosure relates to electrical switches, and more particularly to a rocker switch assembly and method of operation. The rocker switch assembly includes a lever arm structure for activating the rocker switch assembly and a mounting arrangement for securing the rocker switch assembly to an application surface.

BACKGROUND

Electrical switches using push button or plunger type switch actuators have many applications including use in automobile car doors, ignition circuits, power take-offs for lawn mowers and garden tractors, refrigerator doors, home appliances, and the like. These push buttons may be normally open, normally closed or a combination of the two.

It is possible to construct switches having more than two terminals, which combine the features of normally open and normally closed switches. For example, a "double-pole double-throw" switch behaves as a normally open switch and a normally closed switch in parallel operated by a single plunger. When the plunger is in a normal position, a pair of normally closed terminals is bridged and a pair of normally open terminals is isolated. Alternatively, when the plunger is moved to an actuated position, the normally open terminals are bridged and the normally closed terminals are isolated. A "single-pole double-throw" switch behaves like a double-pole double-throw switch in which one of the normally open terminals is coupled to one of the normally closed terminals. When the plunger is in the normal position, a common terminal is bridged with a normally closed terminal while a normally open terminal is isolated. Alternatively, when the plunger is in the actuated position, the common terminal is bridged with the normally open terminal while the normally closed terminal is isolated.

Typically located within a housing supporting electrical switch are electrical components such as contacts, printed circuit boards, etc. that are adverse to contamination, such as water or debris. It is not uncommon for such electrical switches to be exposed to such harsh environments, especially those switches used on garden tractors.

Further discussion relating to the different switch constructions can be found in U.S. Pat. No. 5,528,007 entitled PLUNGER SWITCH AND METHOD OF MANUFACTURE that issued on Jun. 18, 1996 and assigned to the assignee of the present disclosure. U.S. Pat. No. 5,528,007 is incorporated herein by reference in its entirety.

SUMMARY

One example embodiment of the present disclosure includes a rocker switch assembly that includes a housing having an interior cavity for locating electronic components and a plunger member movably located during actuation within the interior cavity of the housing. The plunger member is coupled to at least one contact support. The switch assembly further comprises at least one terminal fixed within the housing. The at least one terminal corresponding with the at least one contact that engages or disengages with the terminal during actuation. A lever structure is pivotly coupled to the housing by a fulcrum fixedly attached to the housing. The lever structure comprises a lever having an upper side for receiving an external force and a lower side for engaging a head on the plunger member to generate actuation of the rocker switch during pivotal rotation of the lever.

Another example embodiment of the present disclosure includes a rocker switch assembly for a garden tractor. The rocker switch assembly comprises a housing having an interior cavity for locating electronic components, the housing also has a protrusion integrally molded and projecting from the housing for mounting the rocker switch assembly. The housing further comprising an eccentric flange having an opening axially aligned with the protrusion for mounting the rocker switch assembly. A plunger member movably located during actuation within the interior cavity of the housing. The plunger member coupled to at least one contact support. At least one terminal is fixed within the housing, the at least one terminal corresponds with the at least one contact that engages or disengages with the terminal during actuation. A lever structure is pivotly coupled to the housing by a fulcrum fixedly attached to the housing. The lever structure comprises a lever having an upper side for receiving an external force and a lower side for engaging a head on the plunger member to generate actuation of the rocker switch assembly during pivotal rotation of the lever.

While another example embodiment of the present disclosure comprises a method of operating a switch assembly. The method comprising the steps of providing a housing having an interior cavity for locating electronic components and actuating a movable plunger member that is located within the interior cavity of the housing. The method also includes the steps of coupling the plunger member to at least one moveably connected contact support and fixing at least one terminal within the housing, the at least one terminal corresponding with the at least one movable contact coupled to the plunger member that engages or disengages with the terminal during actuation. The method also includes pivotly coupling a lever structure to the housing at a fulcrum, and fixedly attaching the fulcrum to the housing, the lever structure comprising a lever having an upper side for receiving an external force and a lower side, the lower side engaging a head on the plunger member to generate actuation of the rocker switch assembly during pivotal rotation of the lever. The method also includes changing the state of the at least one terminal from one of a normally open state and normally closed state to the other of the normally open state and normally closed state by the actuating of the lever to actuate the plunger member.

BRIEF DESCRIPTION OF THE DRAWINGS

The foregoing and other features and advantages of the present disclosure will become apparent to one skilled in the art to which the present disclosure relates upon consideration of the following description of the disclosure with reference to the accompanying drawings, wherein like reference numerals refer to like parts unless described otherwise throughout the drawings and in which.

DETAILED DESCRIPTION

Referring now to the figures generally wherein like numbered features shown therein refer to like elements throughout unless otherwise noted. The present disclosure relates to electrical switches, and more particularly to a rocker switch assembly and method of operation. The rocker switch assembly includes a lever arm structure for activating the rocker switch assembly and a mounting arrangement for securing the rocker switch assembly to an application surface.

Figure 1:
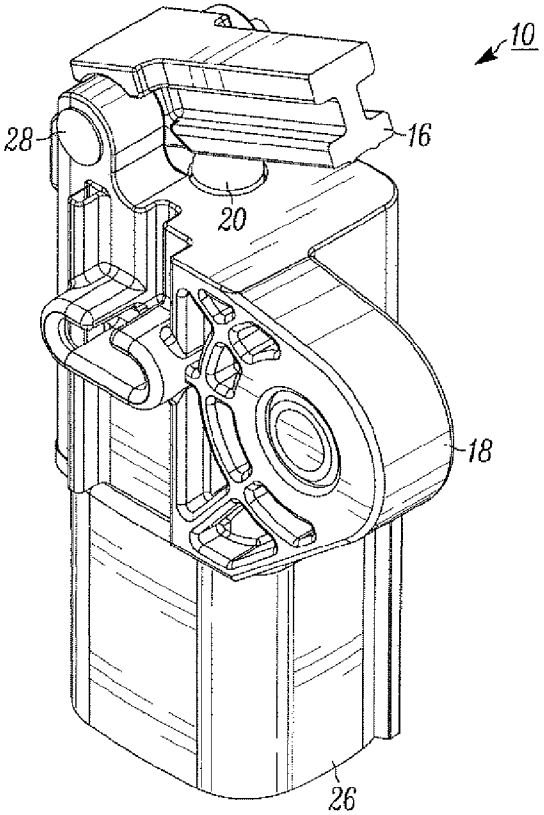
FIG. 1 is a perspective view of a rocker switch assembly constructed in accordance with one example embodiment of the present disclosure.

FIG. 1 illustrates a perspective view of a rocker switch assembly 10 constructed in accordance with one example embodiment of the present disclosure. The switch assembly 10 as would be appreciated by one of ordinary skill in the art operates in both a normally open "NO" or normally closed "NC", single-pole double-throw, and double-pole double-throw configurations, based on the construction of the contact combinations with respective terminals, as further discussed below and in U.S. Pat. Nos. 5,528,007 and 5,221,816, which are incorporated herein by reference in their entireties.

One application of the switch assembly 10 includes a power take-off for a lawn mower indirectly through an electronic control unit or directly, controlling the transfer of power from an engine output shaft to an accessory such as the lawn mower blades. In an alternative example embodiment, the switch assembly 10 includes in addition to normally open (NO) and normally closed (NC) positions, momentary or intermediate positions containing, both, neither, or one of the above positions for one or more terminals. Activation of the rocker switch assembly 10 includes changing the state of one or more terminals from a NO or NC state in one or more terminals extending from the switch.

Terminals extending from the rocker switch assembly 10 are coupled to a wiring harness connector (not shown) as would be appreciated those of ordinary skill in the art. Other applications of the rocker switch assembly 10 include, but are not limited to brake pedal applications for riding mowers or tractors, ignition kill switch, power-take off (PTO) switch, E-Stop switch, gas pedal switch for golf carts, e-brake switch for land vehicles, back-up light switch, dump bed limit switch, marine vehicle trim switch, linkage-activated switch for combines and buses, door activated caution alert switch, handicap or moving truck rear lift equipment/deck switch, and the like.

In the example embodiment of FIGS. 13-16, the rocker switch assembly 10 is mounted for operation to a panel 12 and engaged by a pedal assembly 14 for directional operation of a riding mower, such as forward and reverse controls. It should be appreciated when looking at the drawings how the construct of the rocker switch assembly 10 and its adjustment increases the travel allowed by the pedal assembly 14 and other pedal activated and linkage activated applications as discussed above.

Figure 3:
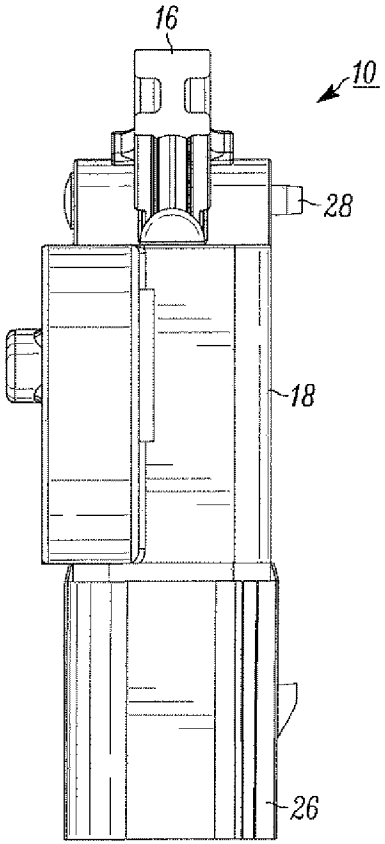
FIG. 3 is a right side elevation view of FIG. 1.
Figure 2:
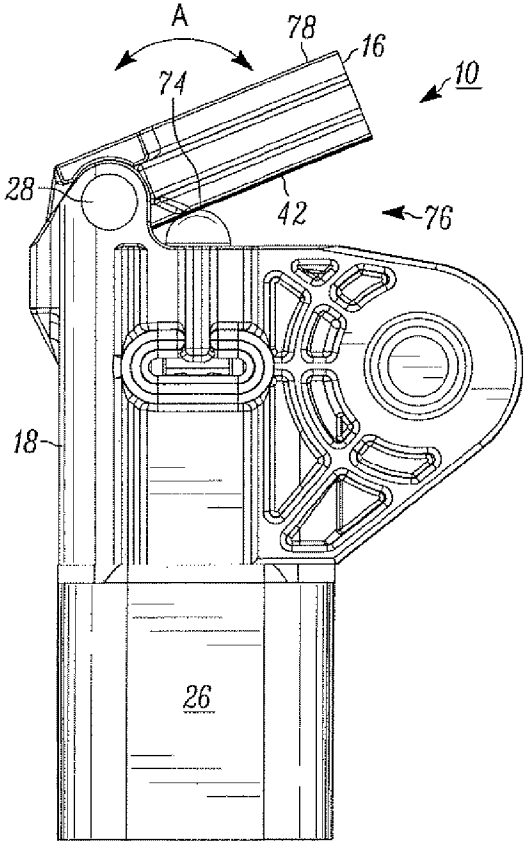
FIG. 2 is a front elevation view of FIG. 1.
Figure 7:
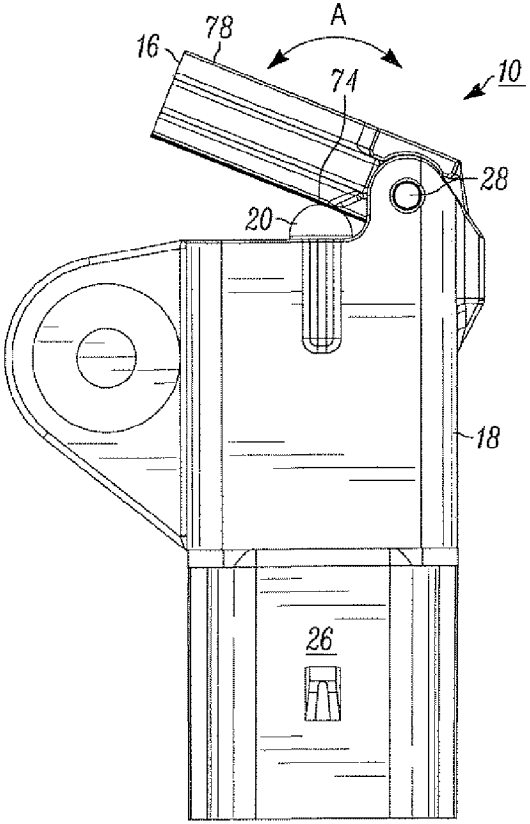
FIG. 7 is a rear elevation view of FIG. 1.
Figure 5:
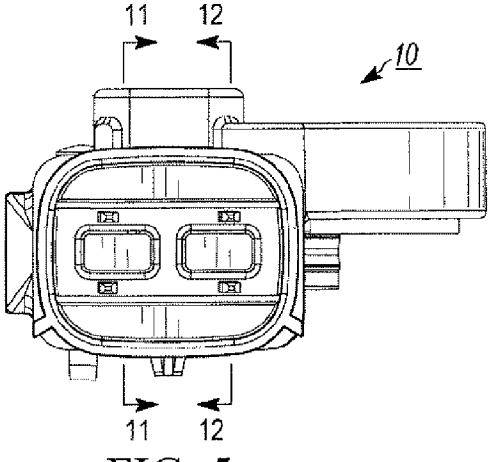
FIG. 5 is a bottom plan view of FIG. 1.
Figure 6:
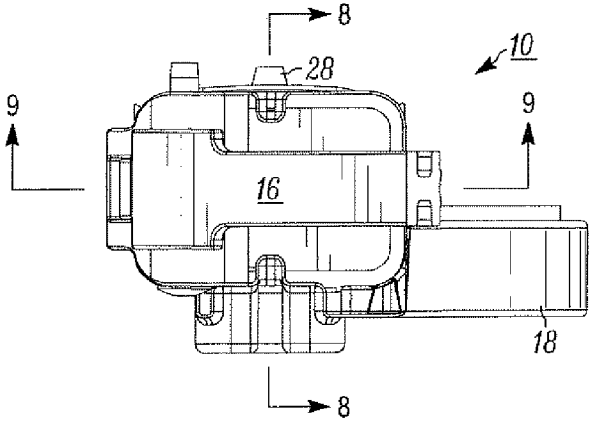
FIG. 6 is a top plan view of FIG. 1.
Figure 4:
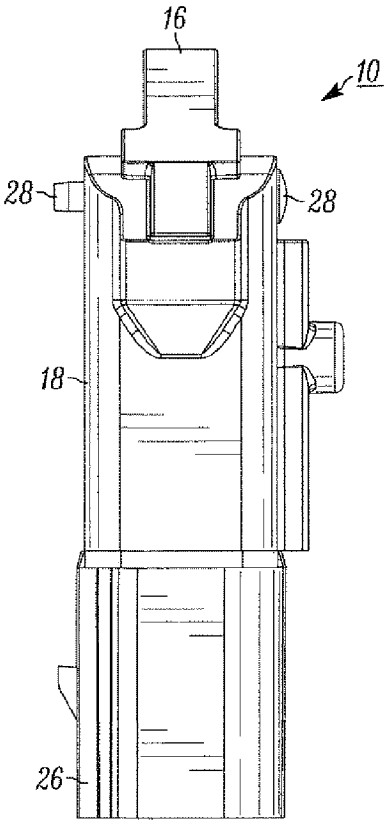
FIG. 4 is a left side elevation view of FIG. 1.
Figure 10A:
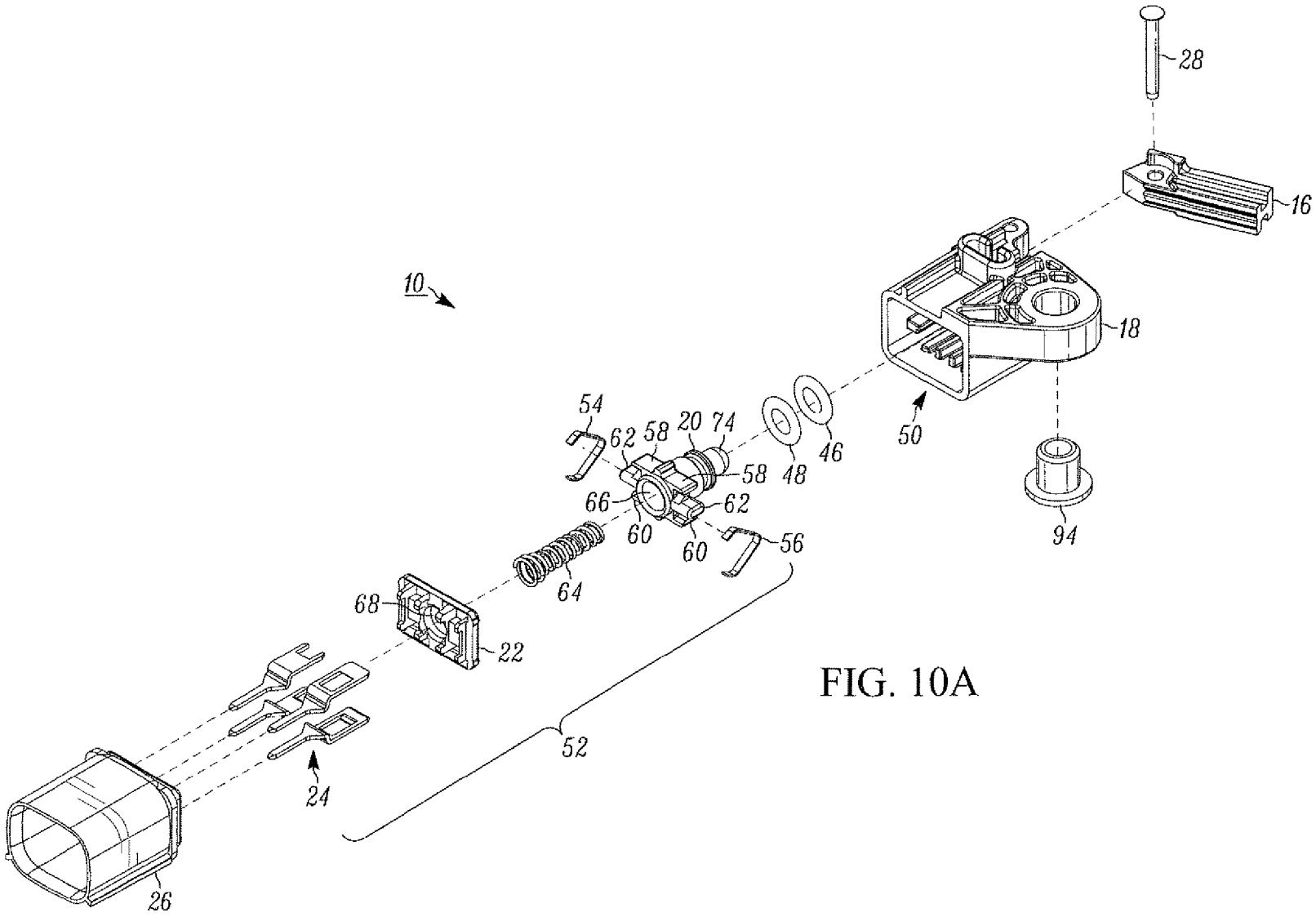
FIG. 10A is an exploded assembly view along a first direction of FIG. 1.
Figure 10B:
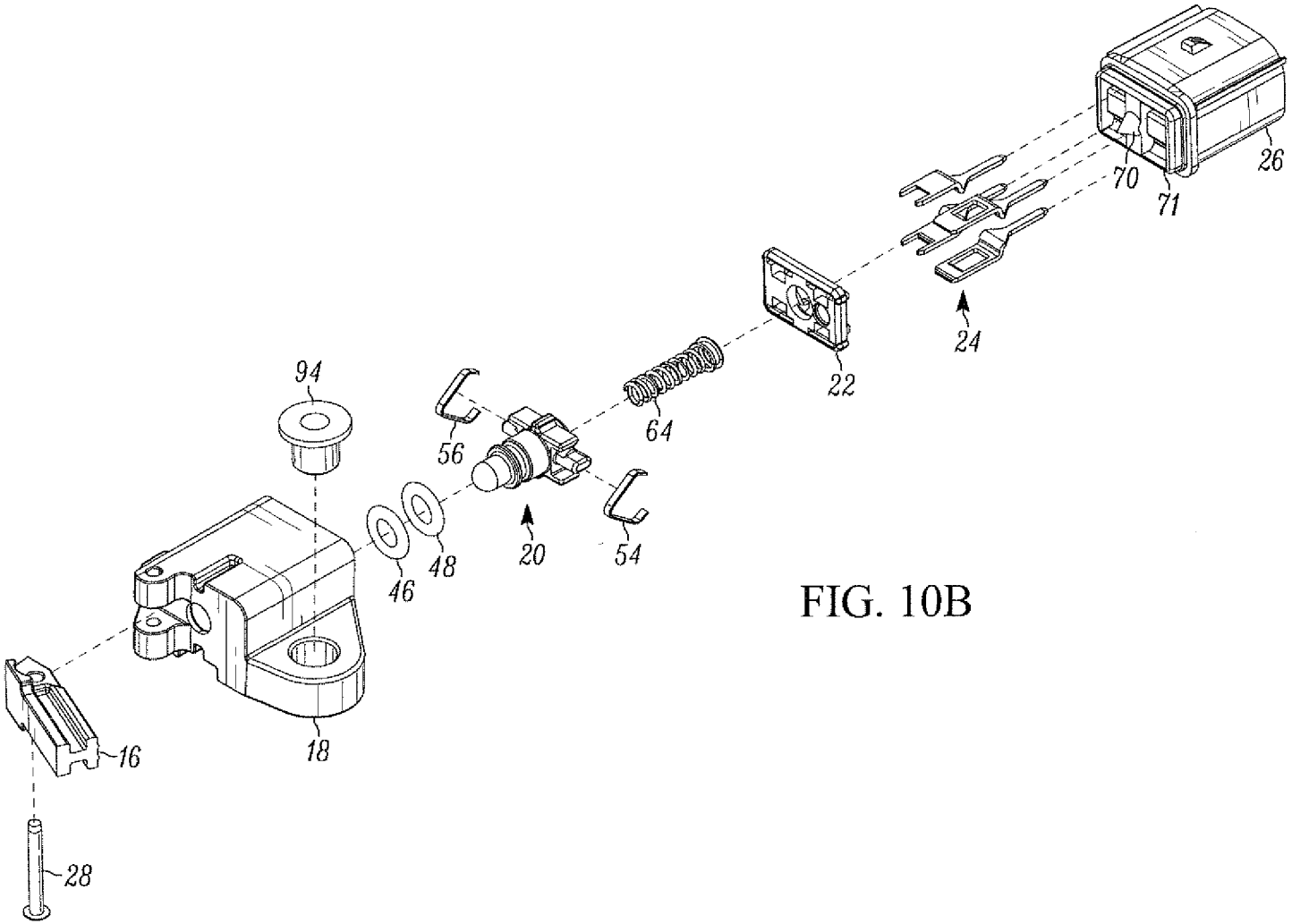
FIG. 10B is an exploded assembly view along a first direction of FIG. 1.
Figure 12:
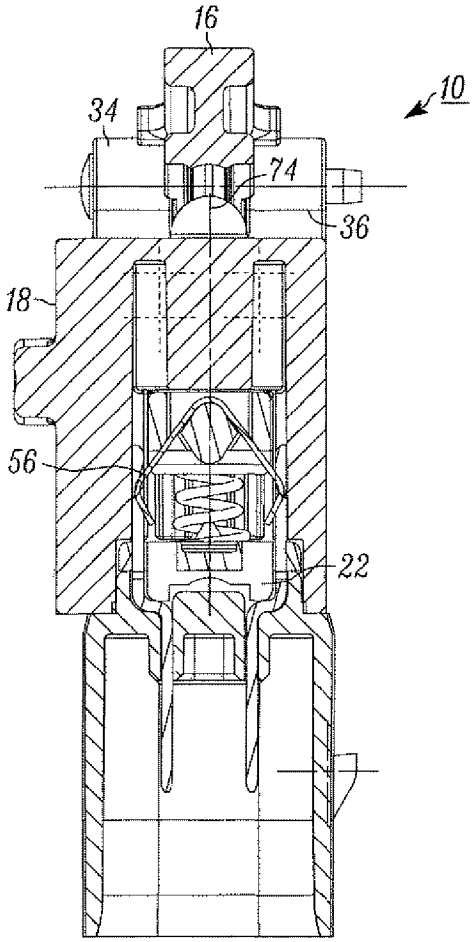
FIG. 12 is a side sectional elevation view of FIG. 1 about section lines 12-12 illustrated in FIG. 6.
Figure 11:
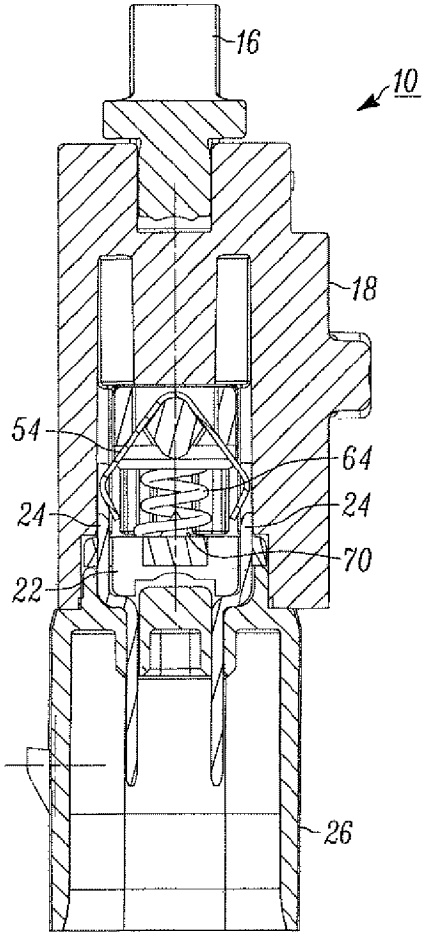
FIG. 11 is a side sectional elevation view of FIG. I about section lines 11-11 illustrated in FIG. 6.
Figure 13:
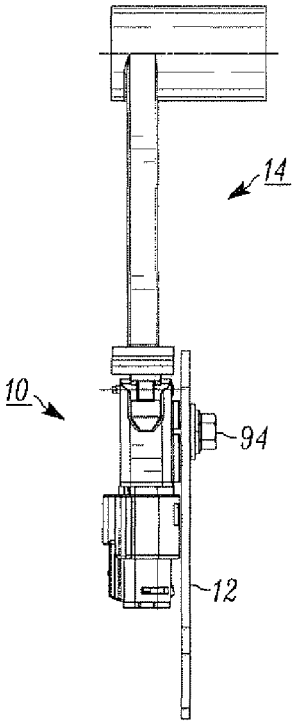
FIG. 13 is a right side elevation view of a rocker switch assembly mounted for operation in accordance to one example embodiment of the present disclosure.

Referring now to FIG. 10 is an exploded view of the rocker switch assembly 10 that comprises a lever 16, housing 18, plunger member 20, terminal guide 22, terminals 24, and cover 26. The lever 16 includes a hinge pin 28 that passes through openings 30, 32 along hinge ears 34, 36, respectively of the housing 18 (see FIGS. 17-25). The hinge ears 34, 36, form a spaced clearance region 38 for the locating and movement of the lever 16. When the lever is positioned in the clearance region 38, the hinge pin 28 passing through opening 30 then through a through aperture 40 of the lever 16 before being secured to opening 32. The lever 16 then freely rotates about the pin 28 as illustrated by arrows A in FIGS. 2 and 7 within the clearance region 38 without contacting the housing 18. The end of the pin 28 is secured by a cotter opening and pin, threaded fastener, or in a press-fit connection within the hinge ears 34, 36 as would be appreciated by those of ordinary skill in the art.

Figure 9:
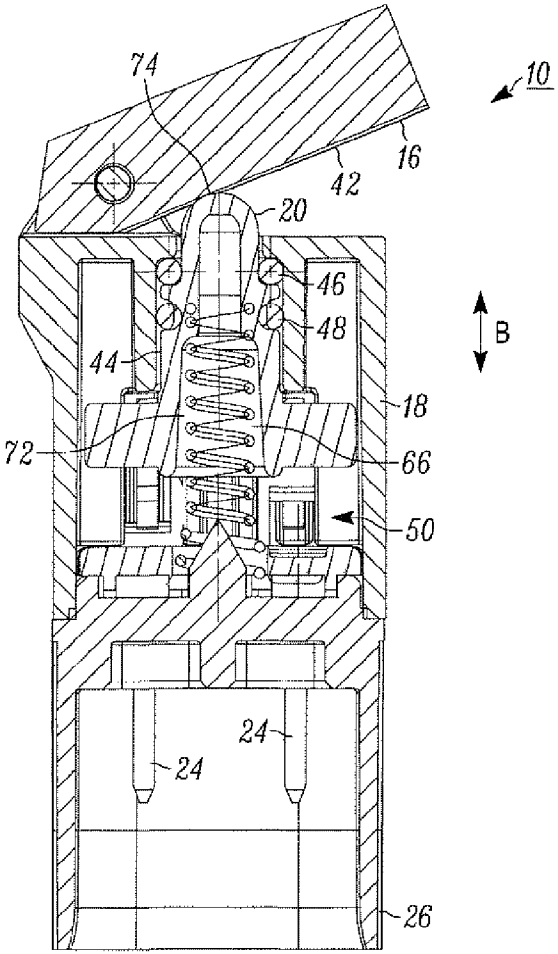
FIG. 9 is a side sectional elevation view of FIG. 1 about section lines 9-9 illustrated in FIG. 6.
Figure 8:
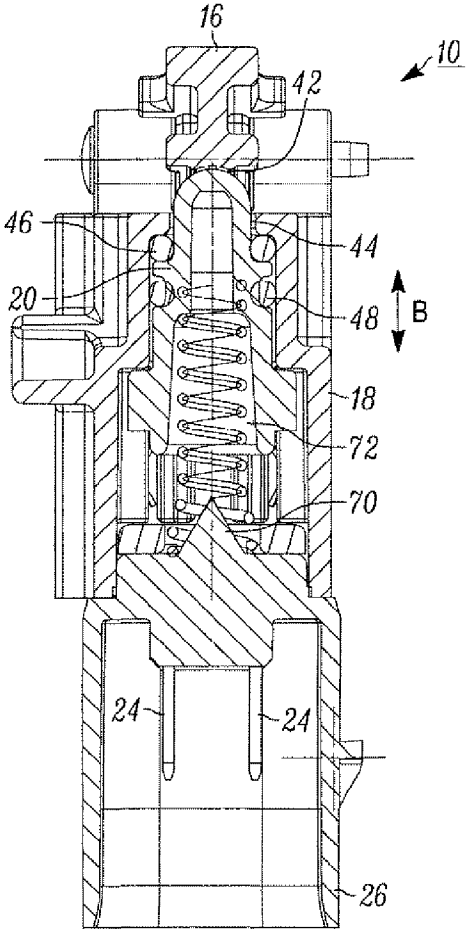
FIG. 8 is a side sectional elevation view of FIG. 1 about section lines 8-8 illustrated in FIG. 6.

Upon rotation, a bottom side 42 of the lever 16 engages and actuates translational motion in the plunger member 20 as indicated by arrows B in FIGS. 8 and 9, thus activating the rocker switch. The plunger member 20 translates within the housing 18 as indicated in FIGS. 8 and 9 and is retained within a channel 44 of the housing. Surrounding the plunger 20 are first 46 and second 48 a-rings that prevent external debris and water from entering an interior cavity 50 of the housing 18 and contaminating electrical components 52 found in the interior cavity of the housing. Such electrical components include terminals 24, terminal guides 22, flat wire contacts 54, 56, and in an alternative example embodiment, printed circuit board (PCB) (not shown). Flat wire contacts 54, 56 are held by plunger ends 58, 60 and straddle a central lobe 62, all projecting from diametrically opposed faces of the plunger member 20. The flat wire contacts are translated with and by the lever 16 engaging the plunger member 20 to move to and from NO and NC terminals, resulting in a change of state as changes in contact occurs, thus activating the rocker switch assembly 10. Further discussion on the operation of the flat wire contacts 54 and 56 and their operation with the terminals 24 is found in U.S. Pat. No. 5,528,007, which is incorporated herein by reference in its entirety.

Biasing member 64 extends in a central bore 66 of the plunger member 20 as illustrated in FIG. 10A. The central bore 66 is a blind hole formed by the plunger member 20. At an end opposite the central bore, the biasing member 64 (such as a coil spring) passes through an opening 68 in the terminal guide 22, engaging a conical post 70, molded into and projecting from a top 71 the cover 26. The conical post 70 and converging seat 72 formed by the central bore 66 (see FIG. 9) hold the biasing member 64 into location and bias a head 74 of the plunger member 20 to maintain constant contact with the bottom of the lever 16. In one example embodiment, the housing 18, cover 26, lever 16, terminal guide 22 and plunger member 20 are formed from plastic.

Figure 15:
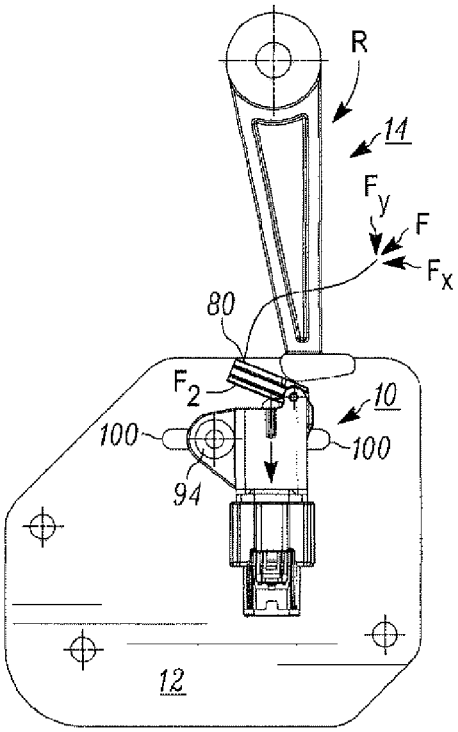
FIG. 15 is a rear elevation view of FIG. 13.
Figure 16:
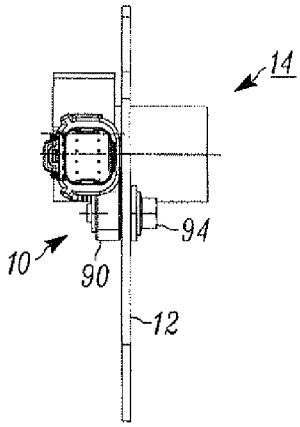
FIG. 16 is a bottom plan view of FIG. 13.

A lever structure 76 comprising the lever 16, hinge pin 28, and hinge ears 34, 36, form a class two (2) lever to activate the plunger member 20 and rocker switch assembly 10. The lever 16 is attached to the housing 18 hinge ears 34, 36 through the hinge pin 28 as discussed above. The hinge pin 28 acts as a fulcrum for the lever 16 and lever structure 76. The spring 64 loaded plunger 20 is the load for the lever 16. The face or top 78 of the lever 16 is actuated by an ancillary system such as the pedal assembly 14. This external force F during operation applied by the pedal assembly 14 is a component force applied by forces in both a longitudinal Fy and lateral Fx directions as illustrated in FIG. 15.

In one example embodiment, the external force F is applied to the lever 16 near the further point away from the fulcrum or hinge pin 28. As this actuated mechanism 14 applies the external force or load to the lever 16, the lever rotates about the central axis of the hinge pin 28. As illustrated in FIGS. 1-7 and 13-16, the plunger member 20 is closer to the hinge pin or fulcrum 28 than the outer most portion 80 of the lever 16 where the external force F is to be applied when the pedal assembly 14 is rotated in the direction of Arrow R when engaged by an operators foot. (see FIG. 15). As the pedal assembly 14 is rotated in the direction of Arrow R, the external load F is applied to the outer most portion 80 of the lever 16, forcing the lever 16 to rotate about the fulcrum or hinge pin 28

Since the current design positions the plunger member 20 closer to the pin 28 than the applied external force F. This longer travel and application of force F at the outer most portion 80 of the lever 16 is translated along the lever 16 to a shorter travel distance to the plunger member 20, advantageously increasing the resulting force F2 on the plunger member (see FIG. 15). This construct of the rocker lever assembly 10, comprising the location of the external load F at the outer most portion 80, relative location of the plunger member 20, and hinge pin 28 further advantageously allow for long travel switch to fit within the small packaging of the rocker switch assembly 10.

The rocker switch assembly 10 operation is accomplished when the lever 16 is rotated, pressing the plunger member 20 in translational motion toward the switch housing 18, applying a greater load based on the length of the lever and the difference between the location of F and F2 along lever 16. As the plunger member 20 is translated into the housing 18 against the biasing member 28, the electrical contacts (formed by the flat wire 54 and 56 to change state relative to the motion and contact with the terminals 24. That is, normally open NO contacts will change to an electrically closed state when the switch 10 is activated by the movement of the lever 16 and plunger 20. Further during this activation, the normally closed NC contacts will become electrically open.

When the external force F is removed from the lever 16, the spring 28 will push against the internal plunger member 20 head 74, such that the plunger member and lever 16 return to its original (upward) position and electrical states. That is the terminals 24 return to the original NO or NC state when the switch is not activated or engaged by an external force F.

Referring now to FIGS. 17-25 are illustrations of the housing 18 constructed in accordance with one example embodiment of the present disclosure. The housing 18 includes a mounting flange 90 that includes an opening 92 for the passage of a fastener 94 such as a screw or bolt. In the illustrated example embodiment, the opening 92 includes a metal threaded insert 96 molded into the housing. The insert 96 is tapped to receive the threaded fastener 94.

Integrally molded into and projecting from the housing 18 is a located protrusion 98. In the illustrated example embodiment, the protrusion 98 is obround and substantially medially located about one side of the housing 18. The protrusion 98 assists in the mounting, locating, and anti-rotation of the switch assembly 10 to the panel 12 as illustrated in FIGS. 13-16.

Figure 14:
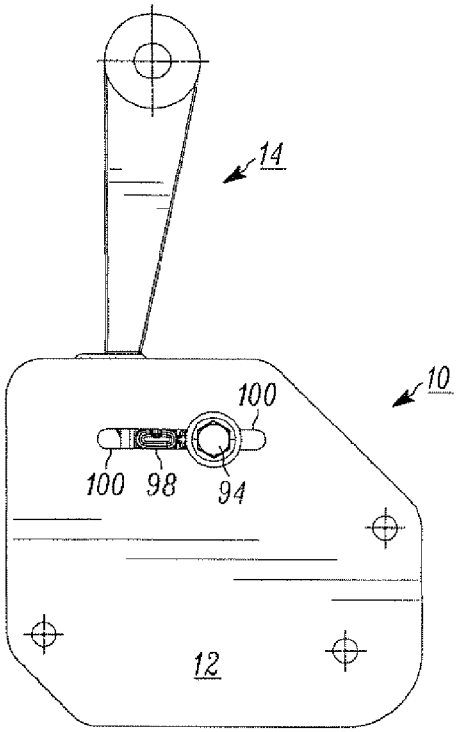
FIG. 14 is a front elevation view of FIG. 13.
Figure 18:
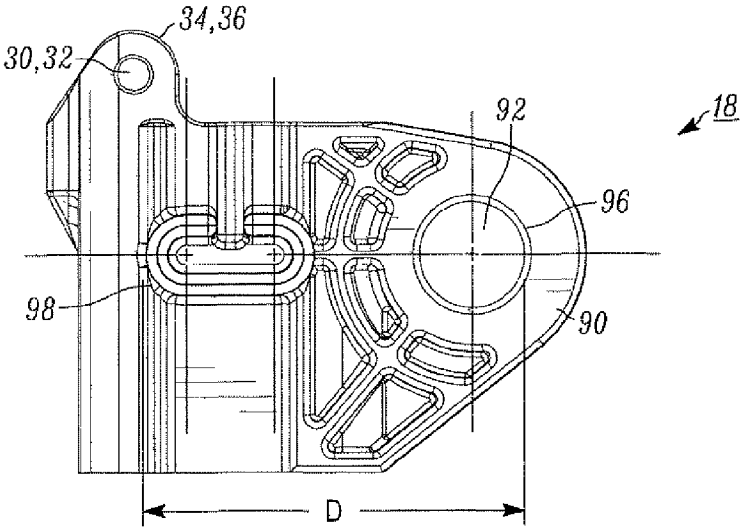
FIG. 18 is a front elevation view of FIG. 17.
Figure 19:
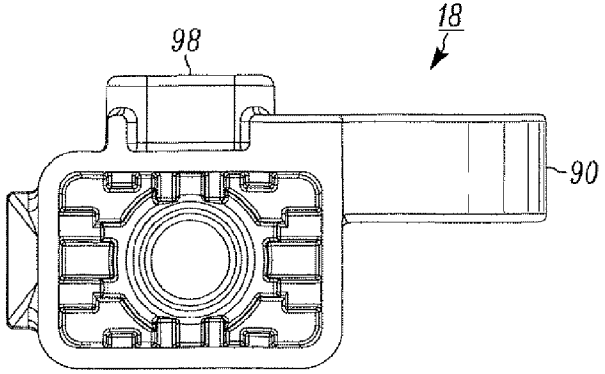
FIG. 19 is a bottom plan view of FIG. 17.
Figure 17:
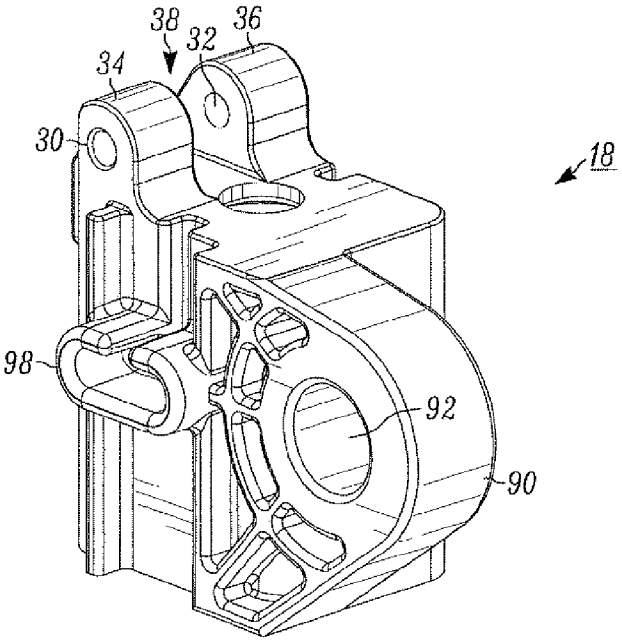
FIG. 17 is a perspective view of a housing.
Figure 20:
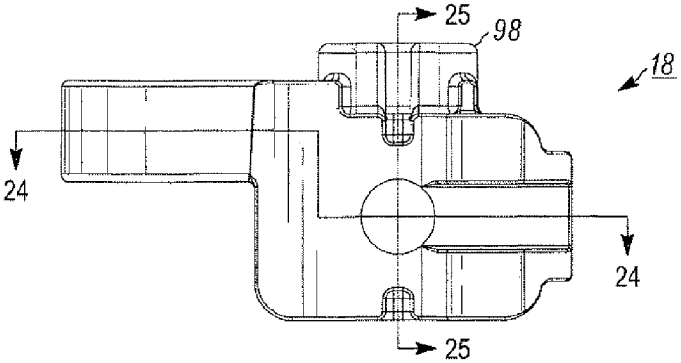
FIG. 20 is a top plan view of FIG. 17.
Figure 22:
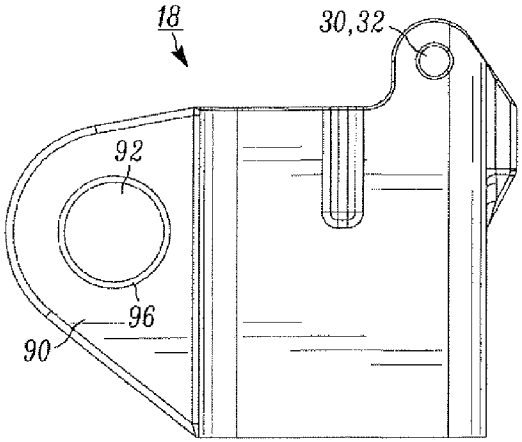
FIG. 22 is a rear elevation view of FIG. 17.
Figure 23:
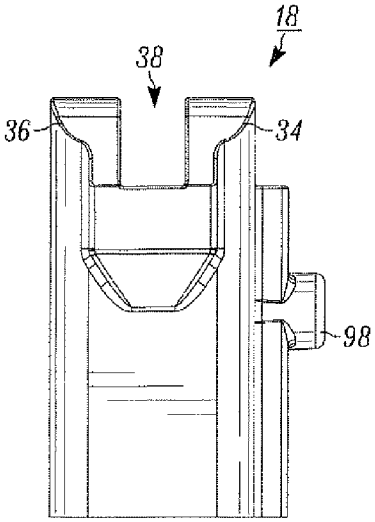
FIG. 23 is a left side elevation view of FIG. 17.
Figure 21:
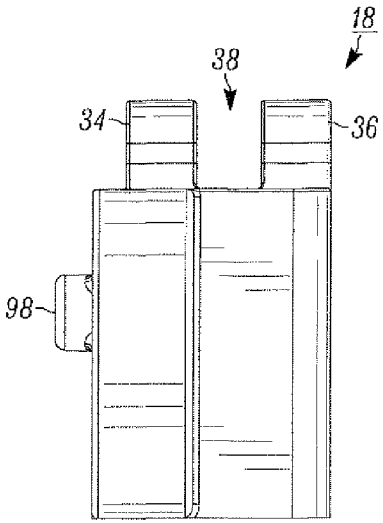
FIG. 21 is a right side elevation view of FIG. 17.
Figure 25:
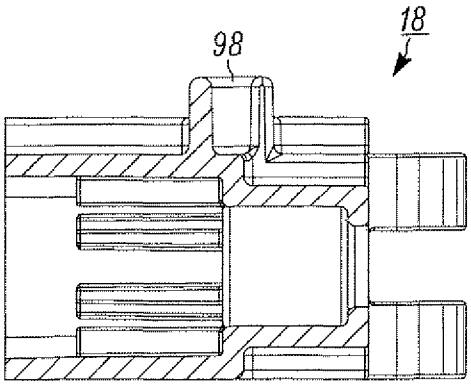
FIG. 25 is a section view of FIG. 17 along section lines 25-25 shown in FIG. 20.
Figure 24:
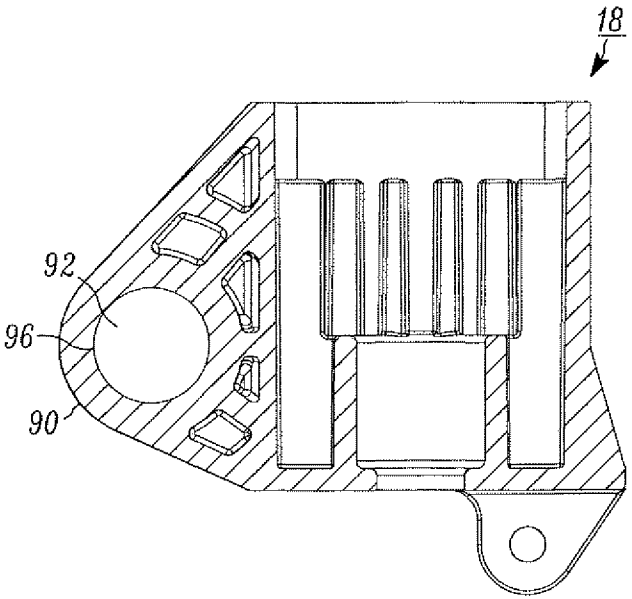
FIG. 24 is a section view of FIG. 17 along section lines 24-24 shown in FIG. 20.

The obround protrusion 98 during assembly to the panel 12 fit in and through a slot 100, as illustrated in FIGS. 14 and 15. The long axis of the obround protrusion 98 is designed to travel along the long axis of the mounting plate 12 slot 100. The axial center of the opening 92 is linearly aligned with the axial centers of the obround protrusion's 98 long axis as illustrated in FIG. 18. The distance between the extremes of the opening 92 and protrusion 98 (shown as dimension D) is smaller than the length of the slot 100, so that both the fastener 94 and protrusion can pass through the slot.

As illustrated in FIGS. 13-16, the metal threaded insert 96 is configured to trap the mounting flange 90 of the housing 18 between the mating mounting plate 12 and the metal threaded fastener 94. The obround protrusion 98 and fastener 94 are configured to provide linear adjustment of the switch assembly 10 within the slot 100 so that optimal contact with the lever 16 with the ancillary assembly 14 at the outer most portion 80 can be achieved.

The construct of the mounting configuration of the rocker switch assembly 10 in FIGS. 13-16 is strong enough to resist deflection of the pedal actuated force F applied to the switch assembly 10 and lever 16. In addition, such mounting construction of the rocker switch assembly as illustrated in FIGS. 13-16, advantageously allows for the switch to be adjustable until the fastener 94 is tightened. Once the fastener 94 is tightened, the obround protrusion 98 of the switch housing 18 is locked into the mounting plate 12 slot 100, stabilizing the rocker switch assembly 10 from rotation during use.

As used herein, terms of orientation and/or direction such as upward, downward, forward, rearward, upper, lower, inward, outward, inwardly, outwardly, horizontal, horizontally, vertical, vertically, distal, proximal, axially, radially, etc., are provided for convenience purposes and relate generally to the orientation shown in the Figures and/or discussed in the Detailed Description. Such orientation/direction terms are not intended to limit the scope of the present disclosure, this application and the invention or inventions described therein, or the claims appended hereto.

What have been described above are examples of the present invention. It is, of course, not possible to describe every conceivable combination of components or methodologies for purposes of describing the present invention, but one of ordinary skill in the art will recognize that many further combinations and permutations of the present invention are possible. Accordingly, the present invention is intended to embrace all such alterations, modifications, and variations that fall within the spirit and scope of the appended claims.

What is claimed is:

1. A rocker switch assembly comprising:

a housing having an interior cavity for locating electronic components;

a plunger member movably located during, actuation within said interior cavity of said housing, the plunger member coupled to at least one contact;

at least one terminal fixed within said housing, said at least one terminal corresponding with said at least one contact that engages or disengages with said terminal during actuation;

a lever structure pivotally coupled to said housing by a fulcrum fixedly attached to the housing, said lever structure comprising a lever having an upper side for receiving an external force and a lower side for engaging a head on said plunger member to generate actuation of the rocker switch assembly during pivotal rotation of the lever;

a biasing member located within the housing for biasing the plunger member into engagement with the lower side of the lever, the biasing member having a centerline that is coaxial with a centerline of the plunger.

2. The rocker switch assembly of claim 1 wherein said housing further comprises a protrusion projecting from said housing for mounting said rocker switch assembly and anti-rotation while receiving an external force to said lever.

3. The rocker switch assembly of claim 2 further comprising a mounting flange having a threaded opening axially aligned with said protrusion for mounting said rocker switch assembly.

4. The rocker switch assembly of claim 3 wherein said protrusion is geometrically obround in shape and centers of said obround geometry are axially aligned with said threaded opening of said mounting flange.

5. The rocker switch assembly of claim 1 wherein contact is maintained between a head on said plunger member and said lower side of said lever by the biasing member, which is captured at a first end on a conical post and a second end projecting into engagement contact with a converging seat located within said plunger member.

6. The rocker switch assembly of claim 1 wherein said plunger member is located between said fulcrum and said upper side of said lever for receiving an external force in order to maximize downward force on said plunger member by said lever during operation.

7. The rocker switch assembly of claim 1 further comprising a mounting flange eccentrically located about said housing having an opening axially aligned with an anti-rotation protrusion for mounting said rocker switch assembly to a power-operated application.

8. The rocker switch assembly of claim 1 wherein said at least one terminal is one of normally open state and normally closed state when said lever structure and plunger member are in a non-activated or actuated position and said at least one terminal is the other of said normally open state and normally closed state when said lever and plunger member are in a activated or actuated position.

9. A rocker switch assembly for a garden tractor, the rocker switch assembly comprising:

a housing having an interior cavity for locating electronic components said housing also having an obround protrusion integrally molded. and projecting from said housing for mounting said rocker switch assembly and said housing further comprising an eccentric mounting flange having a threaded opening axially aligned with centers of said obround protrusion for mounting said rocker switch assembly;

a plunger member movably located during actuation within said interior cavity of said housing, the plunger member coupled to at least one contact;

at least one terminal fixed within said housing, said at least one terminal corresponding with said at least one contact that engages or disengages with said terminal during actuation; and a lever structure pivotally coupled to said housing by a fulcrum fixedly attached to the housing, said lever structure comprising a lever having an upper side for receiving an external force and a lower side for engaging a head on said plunger member to generate actuation of the rocker switch assembly during pivotal rotation of the lever.

10. The rocker switch assembly of claim 9 wherein the biasing member is captured at a first end on a conical post and has a second end projecting into engagement contact with a converging seat located within said plunger member.

11. The rocker switch assembly of claim 9 wherein said plunger member is located between said fulcrum and said upper side of said lever for receiving an external force in order to maximize downward force on said plunger member by said lever during operation.

12. The rocker switch assembly of claim 9 further comprising a biasing member located within the housing for biasing the head of the plunger member into engagement with the lower side of the lever structure, the biasing member having a centerline that is coaxial with a centerline of the plunger.

13. A method of operating a switch assembly, the method comprising the steps of:

providing a housing having an interior cavity for locating electronic components;

actuating a movable plunger member that is located within said interior cavity of said housing, and coupling the plunger member to at least one moveably connected contact support;

fixing at least one terminal within said housing, said at least one terminal corresponding with said at least one movable contact coupled to said plunger member that engages or disengages with said terminal during actuation;

pivotally coupling a lever structure to said housing at a fulcrum, and fixedly attaching said fulcrum to the housing, said lever structure comprising a lever having an upper side for receiving an external three and a lower side, the lower side engaging a head on said plunger member to generate actuation of the rocker switch assembly during pivotal rotation of the lever;

maintaining contact between the plunger member and the lower side of the lever by providing a biasing member in the housing having a centerline that is coaxial with a centerline of the plunger; and changing the state of said at least one terminal from one of a normally open state and normally closed state to the other of said normally open state and normally closed state by the actuating of said lever to actuate said plunger member.

14. The method of claim 13 further comprising the step of positing said plunger member between said fulcrum and said upper side of said lever for receiving an external force in order to maximize downward force on said plunger member by said lever during operation.

15. The method of claim 13, wherein contact is maintained between a head on said plunger member and said lower side of said lever by the biasing member captured at a first end on a conical post and having a second end projecting into engagement contact with a converging seat located within said plunger member.

16. The method of claim 13 further comprising the step of securing said rocker switch assembly to an equipment by providing a protrusion projecting from said housing for mounting in an opening in a panel on the equipment, the protrusion providing said rocker switch assembly anti-rotation properties while receiving an external force to said lever, the method further comprising the step of providing a mounting flange having an opening axially aligned with said protrusion for passing of a fastener through the opening into the panel during the mounting of said rocker switch assembly.

* * * * *